US010962210B2

(12) United States Patent
Gagneux et al.

(10) Patent No.: US 10,962,210 B2
(45) Date of Patent: Mar. 30, 2021

(54) COMPACT HEADLAMP HAVING A PIVOTING LAMP BODY

(71) Applicant: Zedel, Crolles (FR)

(72) Inventors: Tiphaine Gagneux, Grenoble (FR); Raphael Bortolotti, Annecy le Vieux (FR)

(73) Assignee: Zedel S.A.S., Crolles (FR)

( * ) Notice: Subject to any disclaimer, the term of this patent is extended or adjusted under 35 U.S.C. 154(b) by 0 days.

(21) Appl. No.: 16/744,245

(22) Filed: Jan. 16, 2020

(65) Prior Publication Data

US 2020/0232629 A1 Jul. 23, 2020

(30) Foreign Application Priority Data

Jan. 23, 2019 (FR) ..... 1900568

(51) Int. Cl.

| | |
|---|---|
| ***F21V 21/30*** | (2006.01) |
| ***F21V 14/02*** | (2006.01) |
| ***F21V 21/14*** | (2006.01) |
| ***F21V 23/04*** | (2006.01) |
| ***F21Y 115/10*** | (2016.01) |
| ***F21V 21/084*** | (2006.01) |

(52) U.S. Cl.

CPC ..... *F21V 21/30* (2013.01); *F21V 14/025* (2013.01); *F21V 21/145* (2013.01); *F21V 23/0414* (2013.01); *F21V 21/084* (2013.01); *F21Y 2115/10* (2016.08)

(58) Field of Classification Search

CPC ..... F21V 21/30; F21V 14/025; F21V 21/145; F21V 23/0414

USPC ..... 362/105

See application file for complete search history.

(56) References Cited

U.S. PATENT DOCUMENTS 4,631,644 A * 12/1986 Dannhauer ..... F21L 15/14 362/103
5,255,168 A * 10/1993 Stevens ..... F21L 4/04 362/103
5,430,620 A * 7/1995 Li ..... F21L 14/00 362/105

(Continued)

FOREIGN PATENT DOCUMENTS

CN 106287306 1/2017
CN 106287306 A 1/2017

(Continued)

OTHER PUBLICATIONS

European Search Report, File No. 20152916.1-1015, Applicant: Zedel SAS, dated Apr. 20, 2020, 9 pages.

*Primary Examiner* — Bryon T Gyllstrom

(74) *Attorney, Agent, or Firm* — Saile Ackerman LLC; Stephen B. Ackerman

(57) ABSTRACT

A headlamp which includes a pivoting lamp body is presented. The headlamp includes a support with a fixing for a retaining strip on the head of a user. The support has a horizontal base, a first left lateral part and a first right lateral part perpendicular to the base of the support. A lamp body has a light source associated with electrical circuits allowing the control and regulation of the light source. The lamp body is housed between the first and second lateral parts. The lamp body is fixed to the support by means of a mechanical connection combining a pivot function and a translation function to hold the lamp body as close as possible to the support.

12 Claims, 10 Drawing Sheets

(56) References Cited

U.S. PATENT DOCUMENTS

| | | | | |
|---|---|---|---|---|
| 5,800,042 | A * | 9/1998 | Blank | F21L 4/06 362/103 |
| 6,457,838 | B1 * | 10/2002 | Dugmore | F21L 15/14 362/106 |
| 7,568,812 | B1 * | 8/2009 | Kumthampinij | F21L 4/04 362/105 |
| 2005/0036304 | A1 * | 2/2005 | Yu | F21V 33/0076 362/124 |
| 2006/0285316 | A1 * | 12/2006 | Tufenkjian | F21V 21/084 362/105 |
| 2008/0205036 | A1 * | 8/2008 | Tarter | F21L 4/04 362/105 |
| 2010/0177504 | A1 * | 7/2010 | Lau | F21V 21/145 362/105 |
| 2011/0261556 | A1 * | 10/2011 | Gibson | F21V 21/084 362/105 |
| 2012/0206050 | A1 * | 8/2012 | Spero | F21V 23/0464 315/152 |
| 2015/0192282 | A1 * | 7/2015 | Ormsbee | F21L 4/04 315/307 |

FOREIGN PATENT DOCUMENTS

| | | |
|---|---|---|
| CN | 207080828 | 3/2018 |
| FR | 2 946 123 | 12/2010 |
| FR | 2946123 A1 | 12/2010 |

* cited by examiner

COMPACT HEADLAMP HAVING A PIVOTING LAMP BODY

TECHNICAL FIELD

The present invention relates to a headlamp and in particular a compact headlamp comprising a pivoting lamp body.

BACKGROUND

Headlamps, such as those originally used by miners, are subject to a great success in the field of leisure activities, including caving and hiking. They are also widely used professionally.

Generally speaking, headlamps are used in various configurations and professional and recreational uses. To ensure a wide variety of lighting situations, they are also often fitted with a pivoting lamp body allowing precise adjustment of the light beam projected in front of the user.

FIGS. 1A-1E illustrate an example of a conventional headlamp which comprises two distinct parts, each one being movable with respect to the other, namely a support 100 fixed to an elastic band and a lamp body 110 which can pivot with respect to a pivot 101 for allowing an adjustment of the angle of the projected light beam as desired by the user. Thanks to such an adjustable beam, the user can choose to have the light beam projected either directly in front of him or far away to allow him, for example, to use the headlamp in a very mobile activity such as running.

FIGS. 1A to 1E illustrate various angles of rotation of the lamp body 110 with respect to support 100. FIG. 1C corresponds to the configuration in which the axis of the support and the axis of the lamp body merge into a horizontal axis. As can be seen in this figure, but also in FIGS. 1B and 1D, this configuration requires, to allow a large pivoting of the lamp body 110 as illustrated in FIGS. 1A and 1E, to position the pivot 101 to a "certain" distance relatively distant from the base of the support 100, thus resulting a fairly large volume and bulk. To illustrate this relative size, FIG. 1C shows two characteristic distances D1 and D2 between the base of the support and two rear and front planes of the lamp body 110. D1 represents the distance from the base of the support 100 to the rear plane of the lamp body, while D2 illustrates the distance between the base of the support and the front plane of the lamp body.

We realized that this arrangement raises a difficulty when it comes to making a modern headlamp that will produce a strong light beam. In such a situation, it is indeed necessary to provide several high-power LED diodes associated with their electronic supply and control circuitry, as well as suitable cooling devices. In the end, we end up with a headlamp which has a relatively heavy and bulky lamp body 110, which exposes the user to a risk of tilting during sports or very active and dynamic uses, such as running.

In addition, we have also seen the development of a new use of the headlamp, practically worn "around the neck", like a necklace. This configuration has known some success with many users, but also raises the problem of a risk of tipping over of a relatively heavy and bulky lamp, the tilting of which can cause a fall and an accident.

In such a use "around the neck", the volume and the weight of the lamp body cause a risk of tilting making it difficult to adjust the pivot of the headlamp arranged around the neck.

The present invention aims to remedy this problem.

SUMMARY

It is an object of the present invention to provide a compact and economical headlamp which allows a large amplitude of adjustment of the pivot while preserving compactness of the headlamp.

It is another object of the present invention to provide a headlamp consisting of a support and a pivoting lamp body of a particularly compact volume.

To achieve these objectives, the headlamp according to the invention comprises a support comprising a fixing for a retaining strip, the support comprising a horizontal base and two vertical lateral parts perpendicular to the base of the support. The vertical lateral parts more precisely comprise a first left lateral part and a second right lateral part. A pivoting lamp body comprises a light source combined with associated electronic circuits for the control and regulation of the light source.

According to one feature of the invention, the lamp body is located between the lateral parts of the support and is fixed to the latter by means of a complex mechanical connection, which combines a pivot with a translation so as to maintain the lamp body, as the latter comes to pivot, as close as possible to the base of the support.

According to particular embodiments, the headlamp is characterized in that:

the first left lateral part comprises a first horizontal rod and a first curvilinear guide groove situated in the vertical plane of the first left lateral part and having a vertical axis of symmetry;

the second right lateral part comprises a second horizontal rod and a second curvilinear guide groove located in the vertical plane of the second right lateral part and having a vertical axis of symmetry;

the lamp body comprises on a left side a third horizontal rod intended to cooperate with the first curvilinear guide groove of the left lateral part as well as a third rectilinear guide groove intended for guiding in translation of the first rod;

the lamp body comprises on a right side a fourth horizontal rod intended to cooperate with the second curvilinear guide groove of the right lateral part as well as a fourth rectilinear guide groove intended for guiding in translation of the second rod;

Thanks to these features, the guiding of the first and second rods, respectively in the third and fourth rectilinear grooves, simultaneously with the curvilinear guiding of the third and fourth rods in the first and second curvilinear guide grooves, simultaneously ensure a movement of translation and rotation of the lamp body which makes it possible to maintain the latter as close as possible to the base of the support.

This results in a remarkable compactness of the headlamp.

BRIEF DESCRIPTION OF THE DRAWINGS

Other features of one or more embodiments of the invention will appear from the following description of embodiments of the invention, with reference being made to the accompanying drawings.

DESCRIPTION

We now describe a structure of an economical headlamp comprising a lamp body 300 and fixed to a support 200 by means of an innovative and efficient mechanical connection or link, for achieving a simultaneous pivoting and translation of the body with respect to its support.

To achieve this particularly advantageous compactness, the present invention incorporates a mechanical link which combines a pivot function together with a translation function allowing the lamp body 300 to be kept as close as possible to the support 200.

FIGS. 2A to 2E illustrate a first embodiment of a headlamp according to the present invention, shown in five angular adjustment configurations, corresponding to FIGS. 1A-1E mentioned above. It can be seen in particular in FIG. 2C that the two characteristic distances which had been mentioned previously are now much shorter: d1<D1 and d2<D2, implying a much greater degree of compactness for the new headlamp proposed.

Figure 1A:
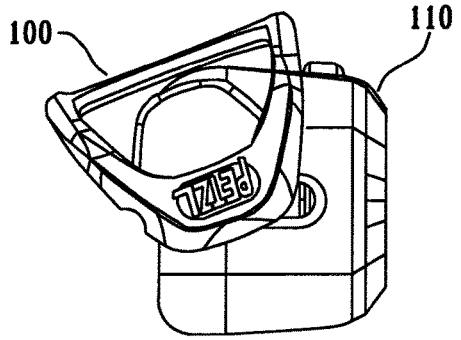
FIG. 1A represents a view of a conventional lamp comprising a lamp body fixed to a support by a connection pivot, in a first angular configuration.
Figure 1B:
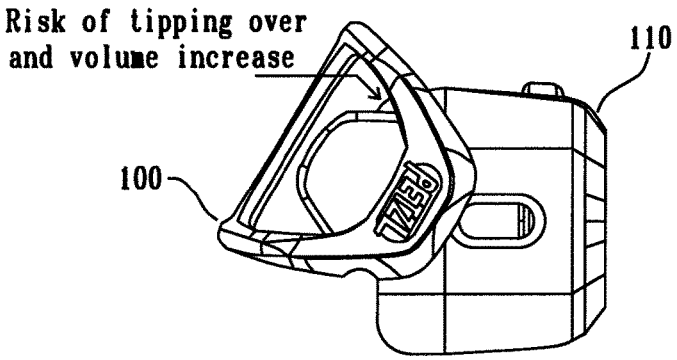
FIG. 1B shows the lamp of FIG. 1A in a second angular configuration
Figure 1C:
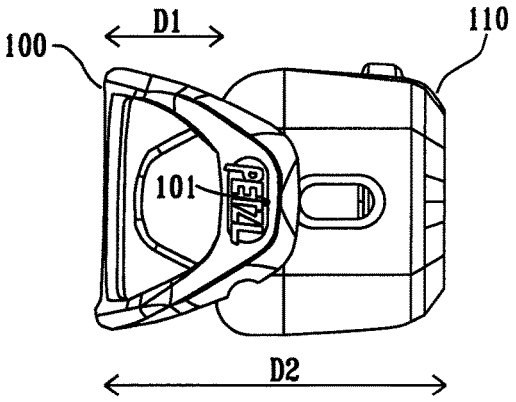
FIG. 1C shows the lamp of FIG. 1A in a third angular configuration
Figure 1D:
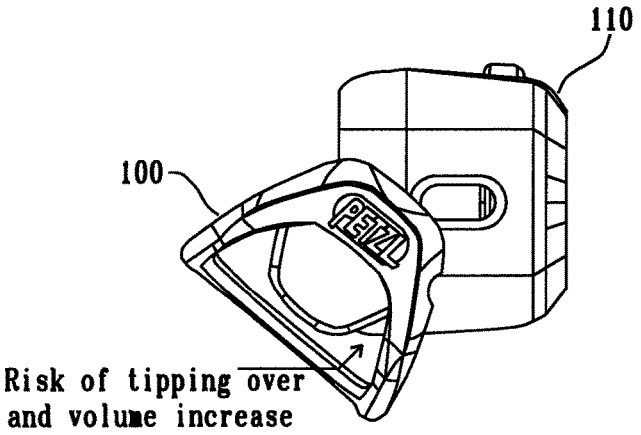
FIG. 1D shows the lamp of FIG. 1A in a fourth angular configuration.
Figure 1E:
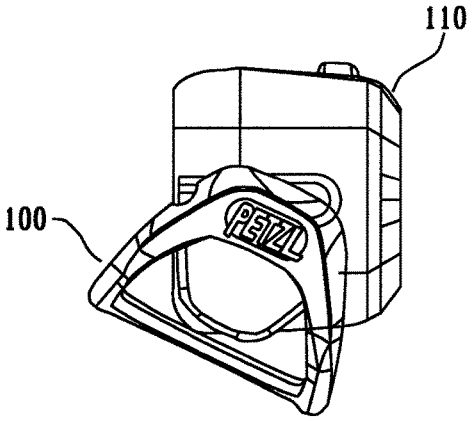
FIG. 1E shows the lamp of FIG. 1*a* in a fifth angular configuration.
Figure 2A:
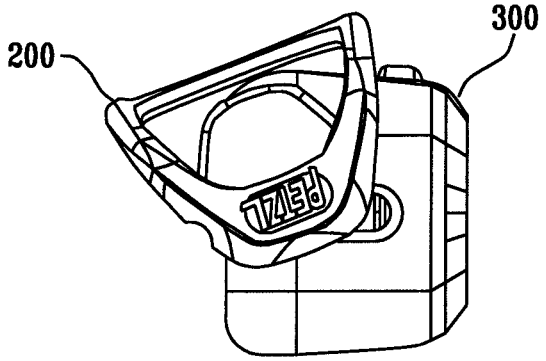
FIG. 2A represents a view of a first embodiment according to the invention, comprising a lamp body fixed to a support by a pivoting link, in a first angular configuration
Figure 2B:
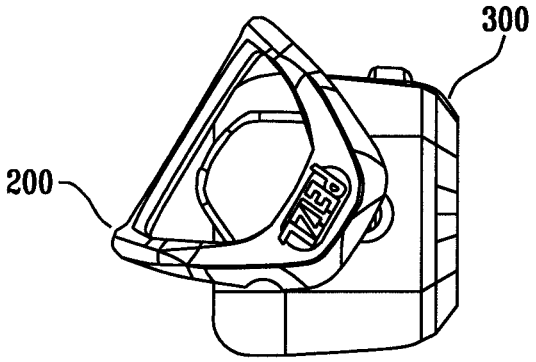
FIG. 2B shows the first embodiment of FIG. 2A in a second angular configuration.
Figure 2C:
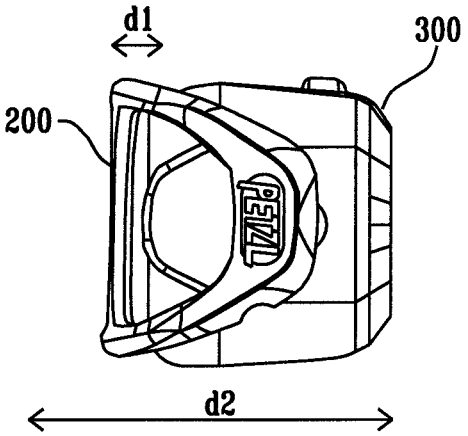
FIG. 2C shows the first embodiment of FIG. 2A in a third angular configuration.
Figure 2D:
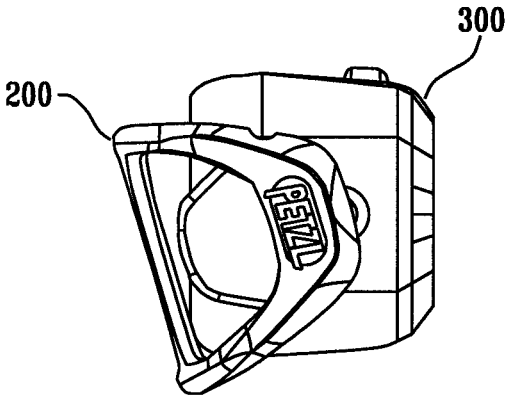
FIG. 2D shows the first embodiment of FIG. 2A in a fourth angular configuration.
Figure 2E:
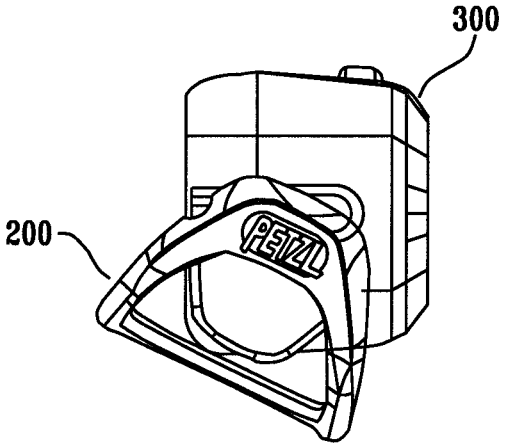
FIG. 2E represents the first embodiment of FIG. 1A in a fifth angular configuration.
Figure 3:
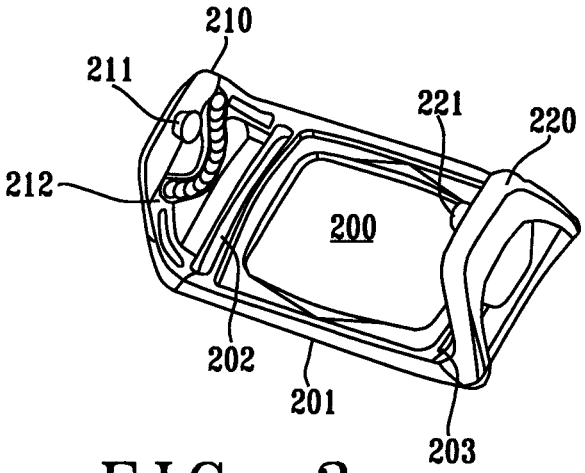
FIG. 3 shows a perspective view of the support of the first preferred embodiment of FIG. 2A.
Figure 4:
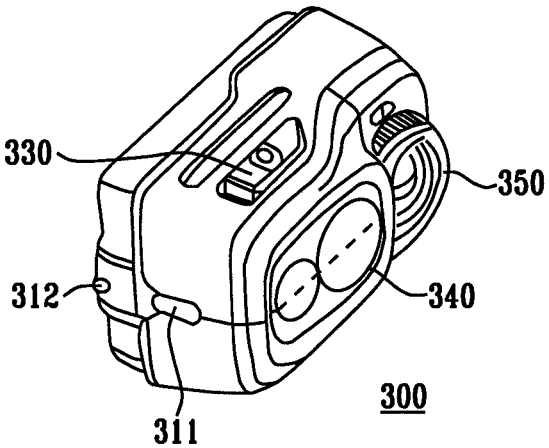
FIG. 4 represents a left perspective view of the lamp body of the preferred embodiment of FIG. 2A.
Figure 5:
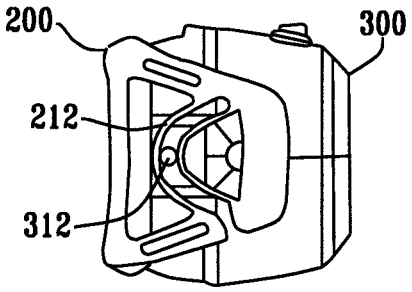
FIG. 5 illustrates the operation of the pivoting function produced by the cooperation between the support and the lamp body of the preferred embodiment.
Figure 6A:
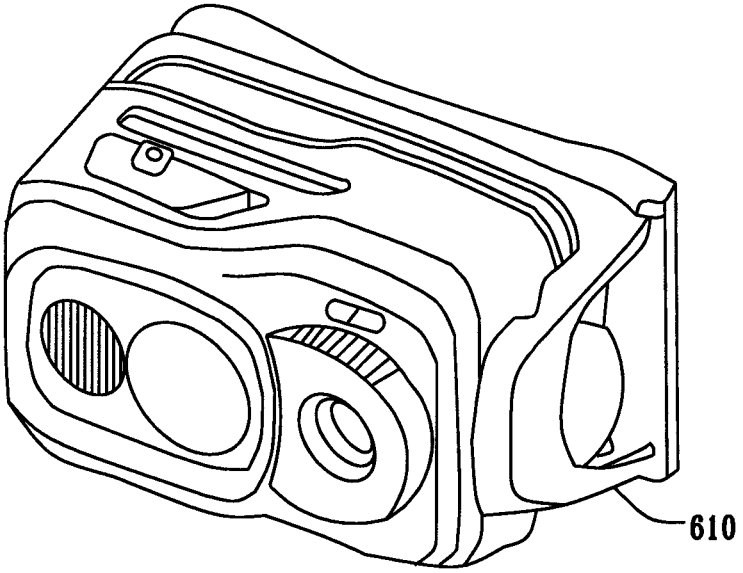
FIGS. 6A, 6B illustrate a front perspective view of an embodiment comprising a removable lamp body.
Figure 6B:
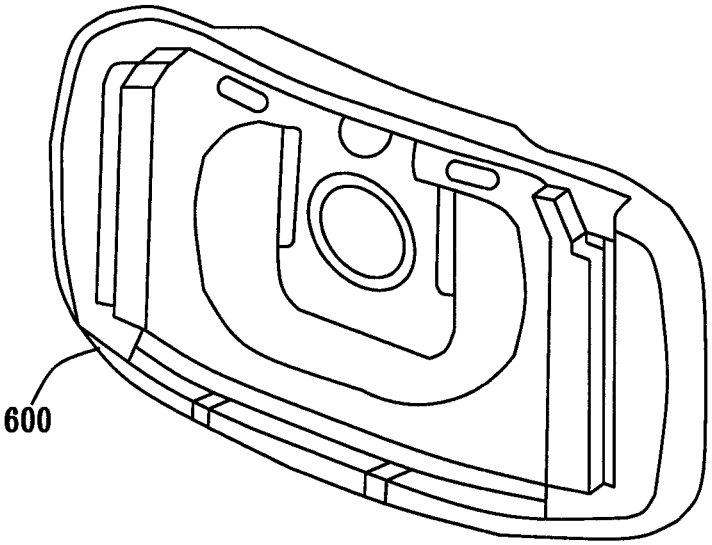
Figure 7A:
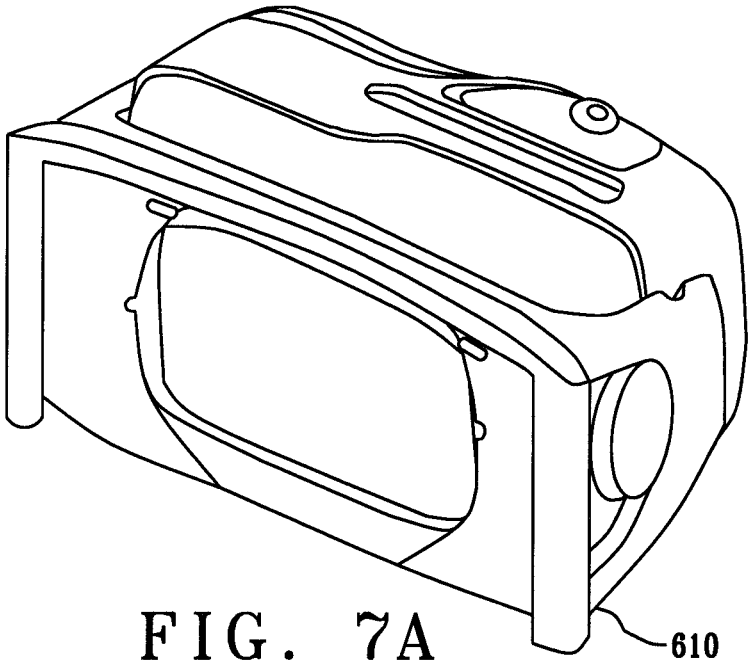
FIGS. 7A, 7B illustrate a rear perspective view of the embodiment of FIG. 5.
Figure 7B:
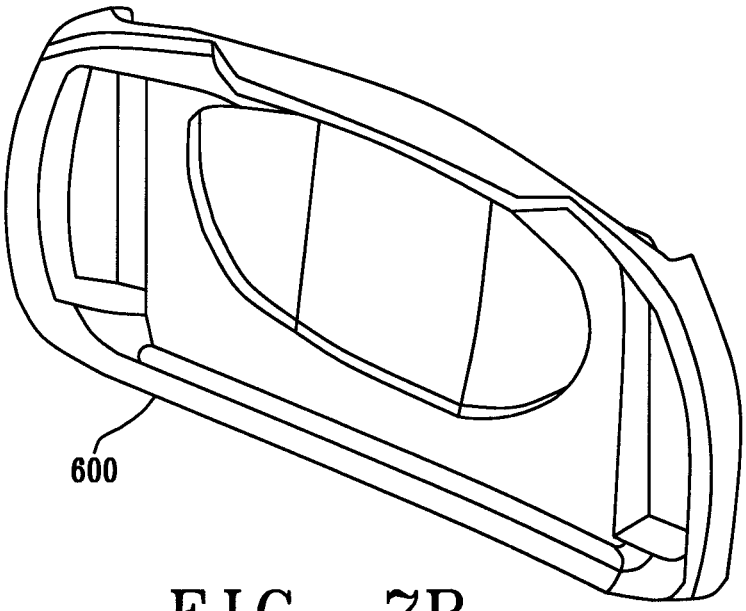

FIGS. 3, 4 and 5 illustrate more specifically the structure of a first preferred embodiment according to the present invention.

The headlamp proposed is based on the combination of a support 200 illustrated in FIG. 3 and a pivoting lamp body 300 shown in FIG. 4. The support 200 comprises a horizontal base 201 provided with two notches 202 and 203 allowing the passage of a retaining strip (not shown in FIG. 3) to fix the support on the head of a user.

In addition to the horizontal base, the support 200 has two vertical lateral parts, respectively left lateral part 210 and right lateral part 220.

The first left lateral part 210 comprises a first horizontal rod 211—preferably in the form of a dovetail—and a first curvilinear guide groove 212 situated in the vertical plane of the left lateral part 210. Preferably, groove 212 has the shape of an ovoid curve having a vertical axis of symmetry identical to the axis of symmetry of the left lateral part.

Similarly, the right lateral part 220 has a second horizontal rod 221—in the form of a dovetail—and a second curvilinear guide groove (not shown in FIG. 3) located in the vertical plane of the second right lateral part 220. The second curvilinear guide groove has a shape similar to that of the first groove 212 and therefore also has a vertical axis of symmetry.

As can be seen in FIG. 3, the support 200 preferably comprises a vertical plane of symmetry passing through the rods 211 and 221.

In addition to the base 200 described above, the headlamp also comprises a lamp body 300, illustrated in FIG. 4, which comprises a light source 340 including one or more LED diodes (s), fitted when appropriate with their own focal system, associated with electronic circuits (not shown) as well as a control switch 330. Preferably, the lamp body 300 has the form of a box which can be arranged between the vertical left later part 210 and right lateral part 220 of the support 200 and which can be linked to them by means of an innovative and most advantageous mechanical link. More specifically, the lamp body 300 has, on its left side, a third horizontal rod 312 which is intended to cooperate with the first curvilinear guide groove 212 of the left lateral part 210. The left side of the lamp body 200 also has a third rectilinear guide groove 311 intended to cooperate with the first dovetail rod 211 and to guide the latter in translation.

The lamp body 300 also comprises a right side comprising a fourth horizontal rod (which does not appear in FIG. 4) intended to cooperate with the second curvilinear guide groove of the right lateral part 220. The right side of the lamp body 300 comprises also a fourth rectilinear guide groove (which does not appear in FIG. 4) intended to cooperate with the dovetail rod 221 and to guide the latter in translation. Thanks to such arrangement, on one hand, the two dovetail rods 211 and 221 of the support 200 cooperate with their respective right and left rectilinear grooves. On the other hand, the two left and right rods of the lamp body 300 also cooperate with their respective curvilinear groove, thus simultaneously achieving a pivoting movement together with a translational movement of the lamp body 300, making it possible to maintain the latter as close as possible to the base 200.

This is illustrated by the relative proportions of the characteristic dimensions d1-d2 in comparison with dimensions D1-D2 of the conventional solution based on a fixed pivot.

FIG. 5 is a section of the left lateral part which illustrates more particularly the positioning of the third rod 312 on the left side of the lamp body 300 inside the curvilinear groove 212 of the left side to guide the pivot of lamp body 300.

Preferably, the first and second grooves 212 have an identical profile and are provided with a notch to allow pivoting by notch of the lamp body 300 relative to its support 200.

In a particular embodiment, the headlamp is configured to be worn "around the neck", and the compact pivoting of the lamp body 300 then allows the adjustment of the light beam even in this very specific configuration well appreciated by the users. This remarkable compactness of the lamp allows it to be used directly "around the neck", without having to be turned over as would be required for a less compact conventional lamp.

In general, the lamp body 300 comprises a light source 340 comprising one or more LED diodes (s) provided, where appropriate with their own focal system, associated with electronic circuits (not shown) and with a control switch which, in the preferred embodiment, will include a locking slide for switch 330 for the purpose of locking the headlamp. Preferably, the light source may consist of a single LED, which will correspond to the most compact embodiment. Alternatively, to increase the brightness, we could consider increasing the number of multi-chip type LEDs (Cree XLM2) combined with large optics, allowing a more sophisticated implementation.

In general, electronic circuits comprising a power module allowing the current supply of the lamp specifically comprise all the components that are conventionally used in an LED lighting lamp for the generation of a high intensity light beam. The power module is generally based on Pulse Width Modulation, well known to a man skilled in the art, and similar to that encountered in circuits Class D audio. Generally speaking, the switch and circuit components that make up the power module—whether they are bipolar transistors, FET (Field Effect Transistor) or MOS (Metal Oxide Semiconductor) or MOSFET transistors—are well known to a person skilled in the art and the presentation will be deliberately lightened in this regard for the sake of brevity. Similarly, we invite the reader to refer to the general documentation dealing with various aspects of PWM modulation. This PWM modulation is controlled by means of the control signal Vc which, in general, refers to an electrical quantity—current or voltage—which makes it possible to control the power module.

Preferably, the electronic circuits include a light sensor 350 making it possible to capture part of the light reflected by the lamp, for the purpose of achieving dynamic lighting control using the reflected light as a feedback signal.

In addition, the circuits also include a control switch 330 allowing the activation or deactivation of the lamp functions and, in the preferred embodiment, a locking slide making it possible to block the lamp functions.

FIGS. 6A, 6B and 7A, 7B respectively illustrate front perspective and rear perspective views of a particular embodiment in which the support and the lamp body are made removable from each other. More specifically, as shown in the figure, the base 600 allows attachment to the strip placed on the user's head, while the rest of the lamp appears in the form of a movable lamp body 610 comprising the rest of the device. In this way, one can very easily separate the lamp body 610 from the base 600.

In order to facilitate the assembly of the headlamp in the manufacturing line, and particularly when using an automatic assembly machine, one can provide each of the rods having the form of dovetail 211 of a flat surface as illustrated in the second embodiment of FIGS. 8A-8E. Indeed, in order to automate the manufacturing line, it is highly desirable to mount the lamp body at the end of the manufacturing line. To this end, to allow the assembly of the lamp body at the end of the line and to avoid to damage each of the rods having the shape of a dovetail, these are then, in this second embodiment, advantageously provided with a flat on the dovetail so that it can enter the groove. We will particularly observe the notching of the curvilinear groove 212 which is present in the second embodiment of FIG. 8A.

Figure 8A:
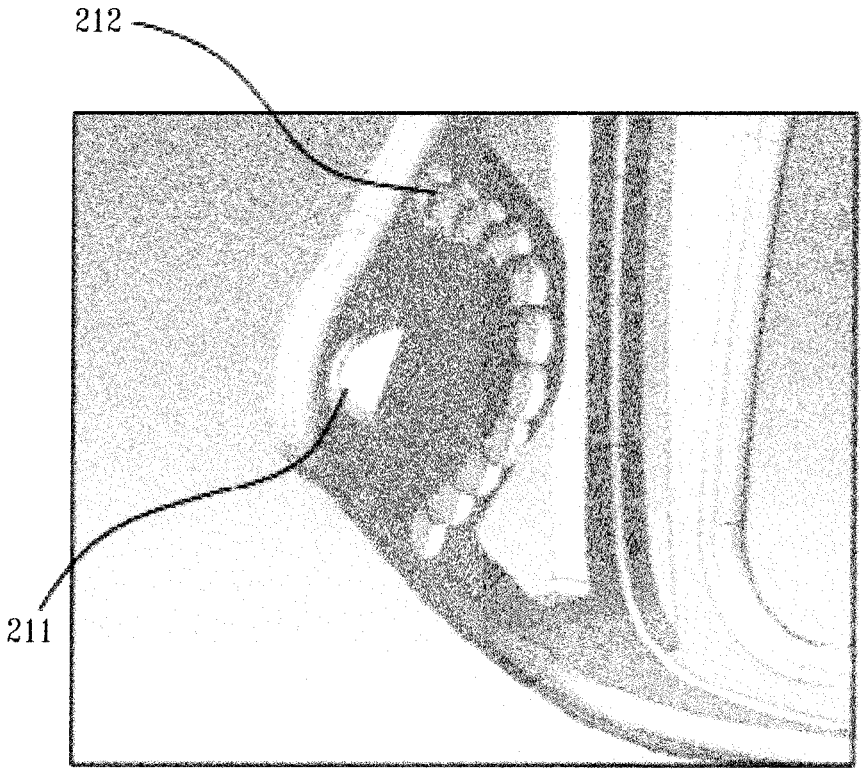
FIG. 8A illustrates a second embodiment in which the dovetail-shaped rods are each provided with a flat surface facilitating the assembly of the lamp in the manufacturing line.
Figure 8B:
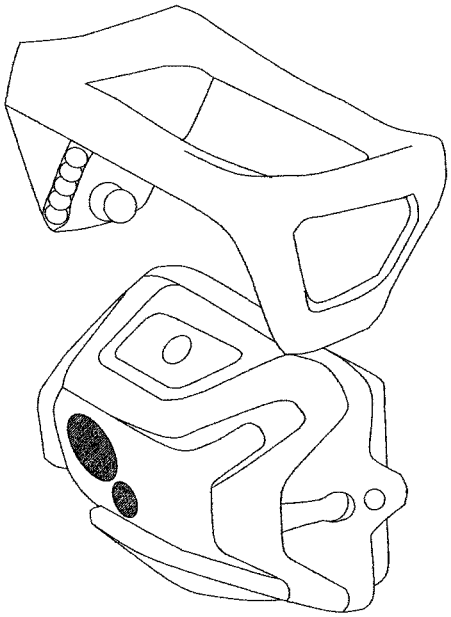
FIGS. 8B-8D illustrate the assembly of the second embodiment.
Figure 8C:
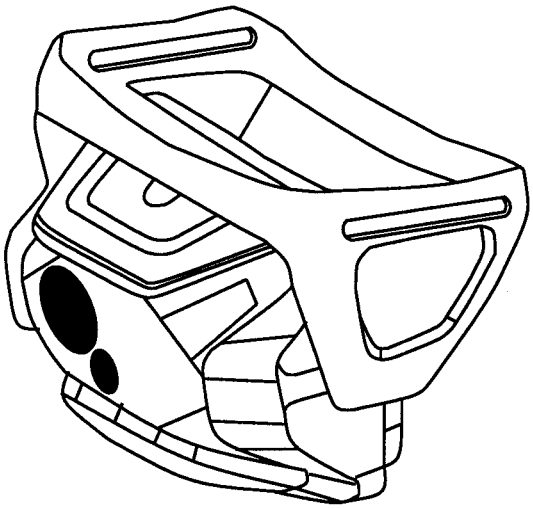
Figure 8D:
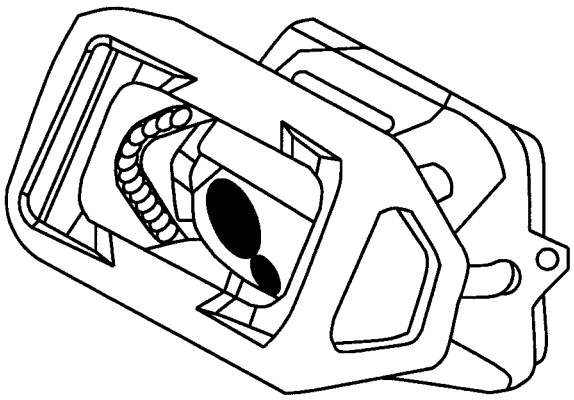
Figure 8E:
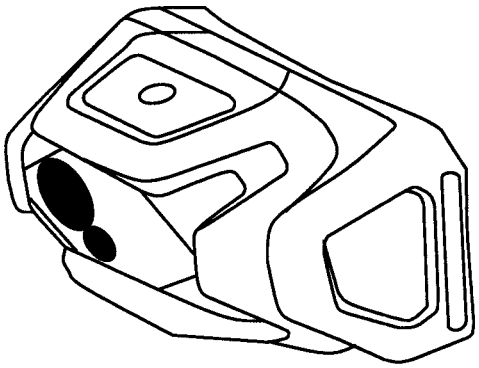
FIG. 8E shows the lamp after assembly is completed.

FIGS. 8B, 8C and 8D illustrate three successive phases of the assembly of the lamp body on its base and FIG. 8E shows the assembly once the assembly is completed.

Figure 9A:
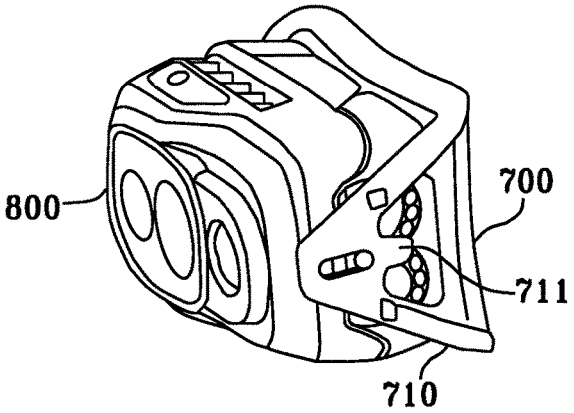
FIGS. 9A-9F illustrate, in various angular configurations, a third embodiment in which the curvilinear groove is located on a lamp body pivoting around two axes, without blocking of the latter.
Figure 9B:
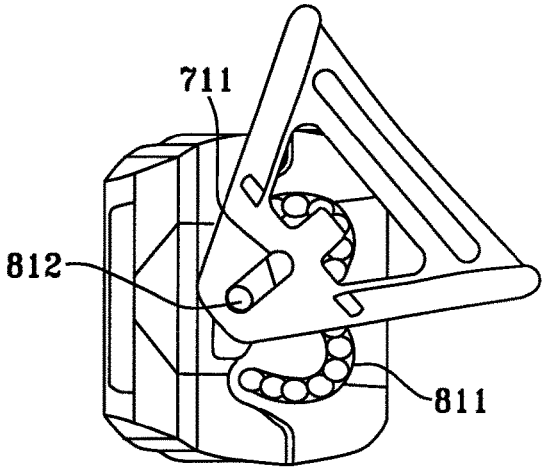
Figure 9C:
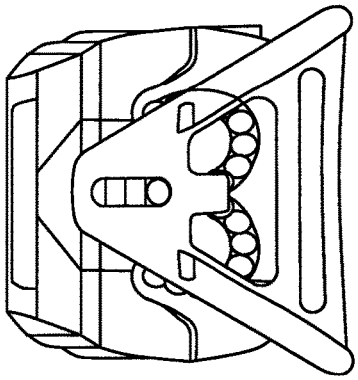
Figure 9D:
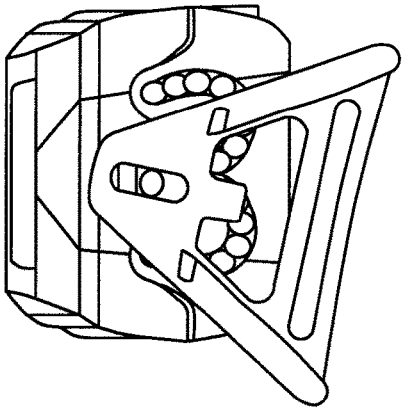
Figure 9E:
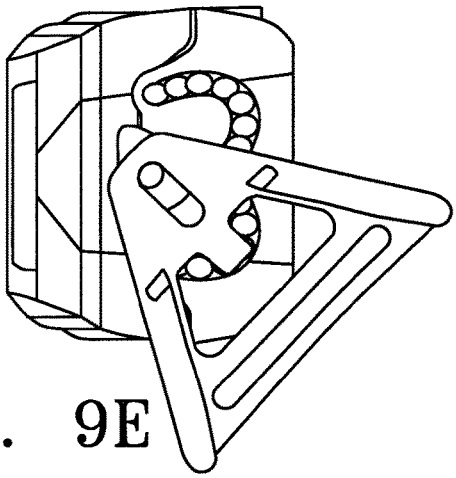
Figure 9F:
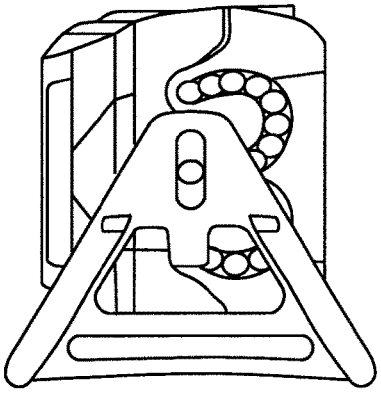
Figure 10A:
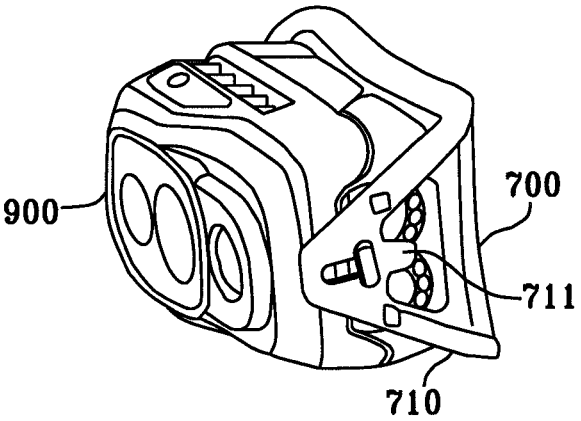
FIGS. 10A-10F illustrate, in various angular configurations, a fourth embodiment in which the curvilinear groove is located on a lamp body pivoting around two axes of rotation each provided with a T-shaped pivot blocking
Figure 10B:
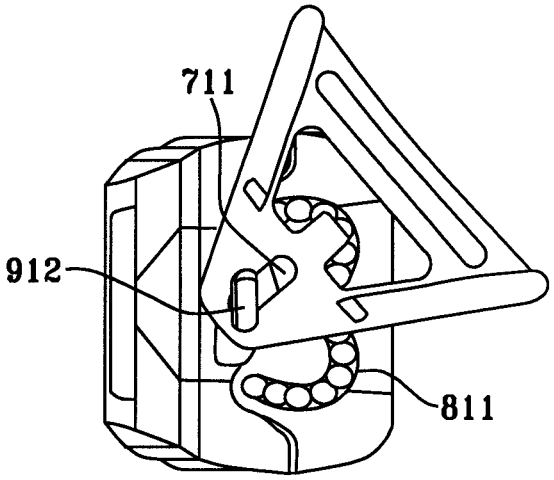
Figure 10C:
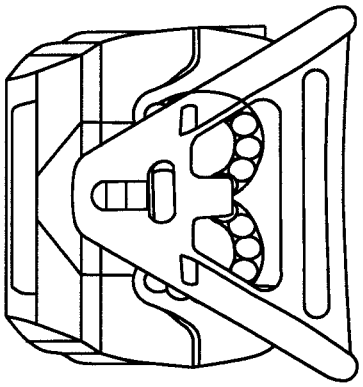
Figure 10D:
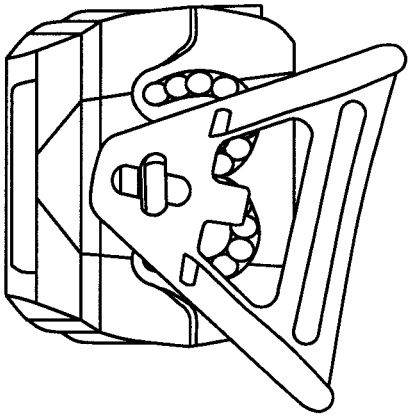
Figure 10E:
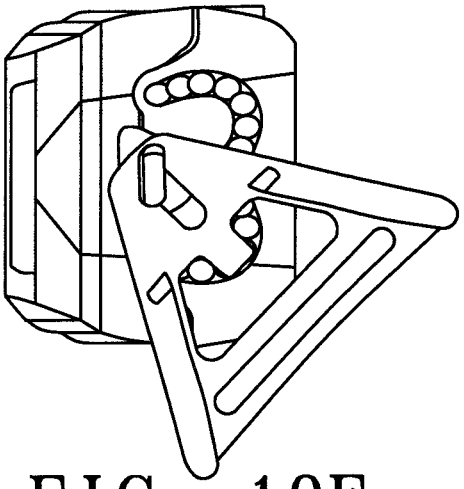
Figure 10F:
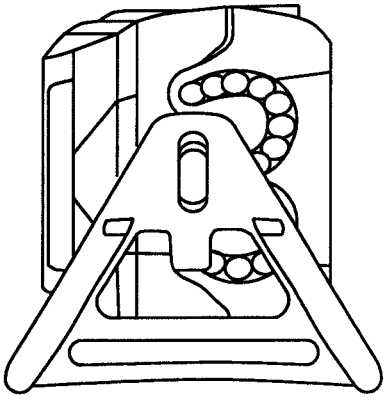
Figure 11A:
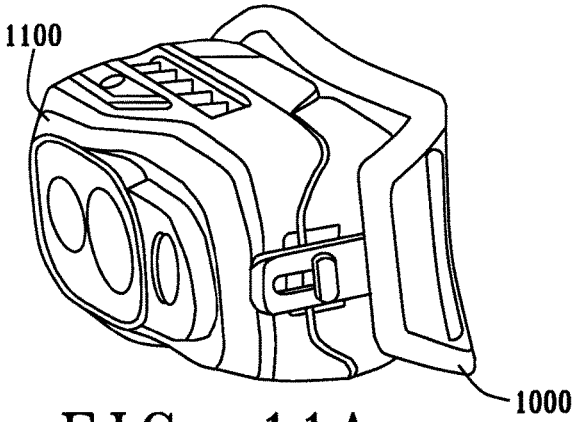
FIGS. 11A-11F illustrate, in various angular configurations, a fifth embodiment devoid of a curvilinear groove, but comprising, on each side of the lamp body, two axes of rotation making it possible to increase the amplitude of rotation of the lamp body.
Figure 11B:
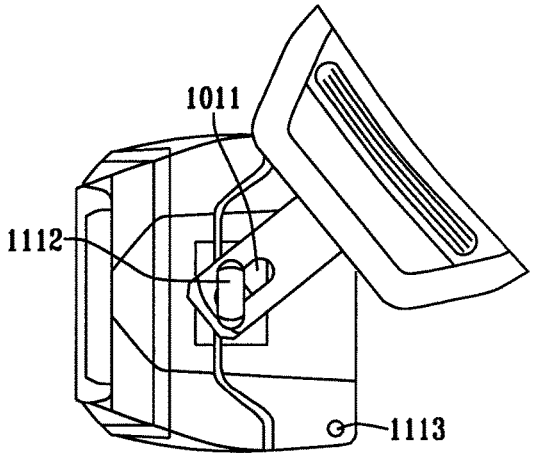
Figure 11C:
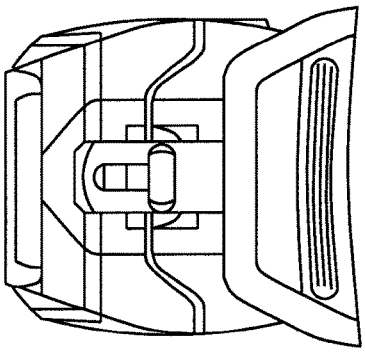
Figure 11D:
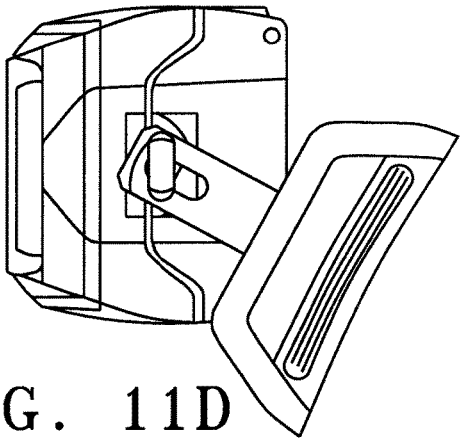
Figure 11E:
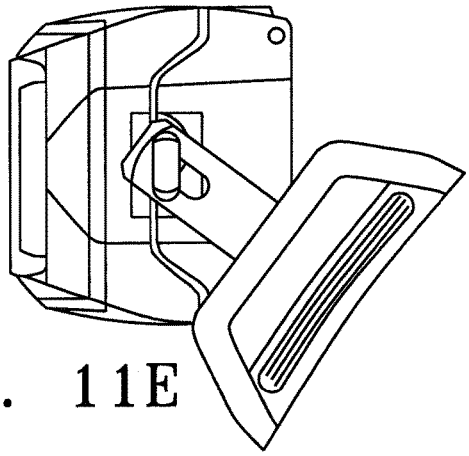
Figure 11F:
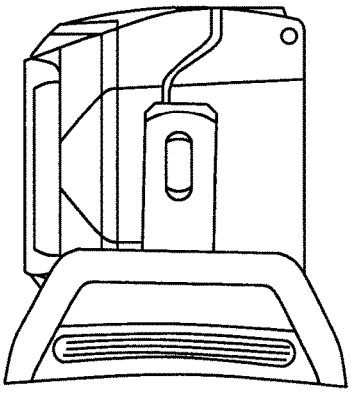

FIGS. 9A-9F illustrate, in various angular configurations, a third embodiment of a lamp body 800 assembled on a base 700. In this third embodiment, the innovative and efficient mechanical link between the lamp body 800 and the base 700 is based according to a configuration opposite to that encountered in the first embodiment. Indeed, as can be seen, the lamp body 800 now comprises, on each of its two lateral parts, two curved guide grooves 811 (cf. FIG. 9B), which previously appeared on the lateral parts of the base 200 and in which come insert two respective rods fixed on the sides of the base 700. Furthermore, the base 700 in turn has two lateral parts 710 which each have a rectilinear guide groove 711, each cooperating with a rod or axis 812 located on one side of the lamp body 800. As can be seen in FIGS. 9A-9B, the rod 812 does not have any blocking. Furthermore, the curvilinear guide grooves which are arranged on the sides of the lamp body 800 are notched and have a profile taking the form of a "3".

FIGS. 10A-10F illustrate, in various angular configurations, a fourth embodiment in which the lamp body is modified to come with a T-shaped rod 912 making it possible to block the pivot 912 sliding in the rectilinear guide groove 711 of base 700.

FIGS. 11A-11F illustrate, in various angular configurations, a fifth embodiment devoid of a curvilinear groove, but comprising, on each side of a lamp body 1100, two axes of rotation 1112 and 1113 making it possible to increase the amplitude of rotation of the lamp body 1100 with respect to its base 1000. In this fifth embodiment, there is therefore a rectilinear guide groove 1011 situated on a lateral part of the base 1000, and which comes to cooperate with the rod 1112—in T shape to ensure a blocking—fixed on the side of the lamp body 1100. The second axis, based on a rod 1113 cooperates with a groove located on a side wall of the support 1000, to provide the guiding in rotation and in translation of lamp body 1100, and increase the amplitude of rotation of the latter.

What is claimed is:

1. A headlamp comprising:

a support comprising a horizontal base and a fixing for a retaining strip; said support comprising two vertical lateral parts, said vertical lateral parts comprising a first left lateral part and a second right lateral part;

a lamp body comprising a light source associated with electrical circuits for the electrical supply and the control of the light source, said lamp body being configured to be located between said first and second lateral parts and connected thereto by means of a mechanical connection combining a pivot function with a translation making it possible to maintain said lamp pivot, as and when the latter is pivoted, as close as possible to the horizontal base of the support, wherein the mechanical connection comprises one curvilinear guide groove and one rectilinear guide groove at one of said lateral parts.

2. The headlamp according to claim 1, wherein:

said first left lateral part comprises a first horizontal rod and a first curvilinear guide groove situated in the vertical plane of the first left lateral part and having an axis of vertical symmetry;

said second right lateral part comprises a second horizontal rod and a second curvilinear guide groove situated in the vertical plane of the second right lateral part and having a vertical axis of symmetry;

said lamp body has on a left side a third horizontal rod intended to cooperate with said first curvilinear guide groove of the left lateral part as well as a third rectilinear guide groove intended to guide in translation said first rod;

said lamp body comprises on a right side a fourth horizontal rod intended to cooperate with said second curvilinear guide groove in the right lateral part as well as a fourth rectilinear guide groove intended to guide in translation said second rod;

whereby the guiding of said first and second rods, respectively in said third and fourth rectilinear grooves, simultaneously with the guiding of said third and fourth rods respectively in the first and second grooves of curvilinear guides simultaneously ensure a translational and rotational movement of the lamp body making it possible to maintain the latter as close as possible to the base of the support.

3. The headlamp according to claim 2 wherein said first and said second rod have the shape of a dovetail intended to come to cooperate with said third and said fourth rectilinear grooves respectively located on the left and right sides of the lamp body.

4. The headlamp according to claim 2 wherein said first and said second grooves are provided with notches to allow pivoting by notch of the lamp body relative to the support.

5. The headlamp according to claim 3 wherein the lamp is configured to allow a use "around the neck", wherein the pivoting of the lamp body makes it possible to allow adjustment of the light beam while reducing the risk of unwanted tilting during a running activity.

6. The headlamp according to claim 1, wherein the electronic circuits comprise a switch provided with a locking slide making it possible to block the control of the electronic circuits.

7. The headlamp according to claim 1, wherein the electronic circuits include a light sensor (350) making it possible to capture part of the light reflected by the lamp, for the production of dynamic lighting when the headlamp is in use.

8. The headlamp according to claim 1 in which the lamp body is removable from the base.

9. The headlamp according to claim 2 wherein said first and second rods are each provided with a flat to facilitate mounting of the lamp body on the lamp in the manufacturing line.

10. The headlamp according to claim 1 characterized in that said lamp body comprises, on each of its two lateral parts, two curvilinear guide grooves in which are inserted two respective rods fixed on lateral parts of said base, and in which said base has two lateral parts which each have a rectilinear guide groove each cooperating with a rod located on one side of said lamp body.

11. The headlamp according to claim 10 in which said rod has a T-shaped profile so as to block the lamp body vis-à-vis the base.

12. The headlamp according to claim 1 in which said mechanical connection between the lamp body and the base is produced by means of a rectilinear guide groove located on each of the lateral parts of the base, and two axes located on each side of the lamp body, in which one of the two axes is guided in the rectilinear guide groove of the corresponding lateral part.

* * * * *